US010431165B2

(12) United States Patent
Kim et al.

(10) Patent No.: US 10,431,165 B2
(45) Date of Patent: Oct. 1, 2019

(54) DISPLAY APPARATUS AND METHOD OF DRIVING THE SAME

(71) Applicant: SAMSUNG DISPLAY CO., LTD., Yongin-si, Gyeonggi-Do (KR)

(72) Inventors: Gigeun Kim, Sejong-si (KR); Jung-Won Kim, Seoul (KR); Sungjae Park, Wonju-si (KR); Jaesung Bae, Suwon-si (KR); Nam-Gon Choi, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 72 days.

(21) Appl. No.: 15/870,293

(22) Filed: Jan. 12, 2018

(65) Prior Publication Data

US 2018/0226032 A1 Aug. 9, 2018

(30) Foreign Application Priority Data

Feb. 8, 2017 (KR) ..... 10-2017-0017360

(51) Int. Cl.
*G09G 3/34* (2006.01)
*G09G 5/02* (2006.01)

(52) U.S. Cl.
CPC ..... *G09G 3/3406* (2013.01); *G09G 5/02* (2013.01); *G09G 2320/0646* (2013.01); *G09G 2340/06* (2013.01); *G09G 2360/16* (2013.01)

(58) Field of Classification Search
CPC .. G09G 5/02; G09G 2360/16; G09G 2340/06; G06F 7/001; H04N 9/646
See application file for complete search history.

(56) References Cited

U.S. PATENT DOCUMENTS

2012/0044277 A1* 2/2012 Adachi ..... G09G 3/3426 345/690
2013/0293596 A1 11/2013 Atkins
2014/0307007 A1* 10/2014 Cho ..... G09G 3/3406 345/690
2015/0228090 A1* 8/2015 Okawa ..... G09G 5/02 345/604
2015/0228215 A1* 8/2015 Nose ..... G06T 11/001 345/590

FOREIGN PATENT DOCUMENTS

KR 1020140037477 3/2014
KR 1020140103757 8/2014
KR 10-1528146 6/2015
KR 1020170088461 8/2017

* cited by examiner

*Primary Examiner* — Kevin M Nguyen
(74) *Attorney, Agent, or Firm* — F. Chau & Associates, LLC

(57) ABSTRACT

A display apparatus includes a timing controller configured to convert input image data into a hue, saturation, brightness (HSV) color space to generate a saturation histogram, generate a saturation gain curve and a dimming value based on the saturation histogram, control saturation of an input image based on the saturation gain curve to generate a data signal, and control luminance of the input image based on the dimming value to generate a light source control signal. A data driver is configured to generate data voltages based on the data signal. display panel is configured to display an output image based on the data voltages. A light source is configured to provide light to the display panel based on the light source control signal.

20 Claims, 11 Drawing Sheets

SATURATION HISTOGRAM

SATURATION CURVE

DISPLAY APPARATUS AND METHOD OF DRIVING THE SAME

CROSS-REFERENCE TO RELATED APPLICATION

This application claims priority under 35 U.S.C. § 119 to Korean Patent Application No. 10-2017-0017360, filed on Feb. 8, 2017 in the Korean intellectual Property Office (KIPO), the contents of which are herein incorporated by reference in their entireties.

TECHNICAL FIELD

The present disclosure relates generally to display devices, and more particularly to display apparatuses and methods of driving the display apparatuses.

DISCUSSION OF THE RELATED ART

A display apparatus such as liquid crystal display ("LCD") apparatuses and organic light emitting diode ("OLED") display apparatuses includes a display panel and a panel driver. The display panel includes a plurality of gate lines, a plurality of data lines, and a plurality of pixels connected to the gate lines and the data lines. The panel driver includes a gate driver providing gate signals to the gate lines and a data driver providing data voltages to the data lines.

The LCD apparatus includes a first substrate including a pixel electrode, a second substrate including a common electrode, and a liquid crystal layer disposed between the first and second substrates. An electric field is generated across the liquid crystal layer by the voltages applied to the pixel electrode and the common electrode. By adjusting an intensity of the electric field, a transmittance of light passing through the liquid crystal layer may be adjusted so that a desired image may be displayed.

The OLED display apparatus displays images using OLEDs. Each OLED generally includes an organic layer disposed between two electrodes, e.g., an anode and a cathode. Holes from the anode may be combined with electrons from the cathode within the organic layer that is disposed between the anode and the cathode and light is accordingly emitted as the holes and electrons combine within the organic layer.

Meanwhile, technology has been used to provide a high dynamic range ("HDR") in display panels, HDR display panels may have an enhanced color characteristics in which bright colors appear brighter and dark colors appear darker (e.g. a higher contrast ratio), than what is generally provided within a display panel. When an image having the high contrast ratio is displayed, the viewer perceives greater image saturation.

SUMMARY

A display apparatus includes a timing controller configured to convert input image data into a hue, saturation, brightness (HSV) color space to generate a saturation histogram, generate a saturation gain curve and a dimming value based on the saturation histogram, control saturation of an input image based on the saturation gain curve to generate a data signal, and control luminance of the input image based on the dimming value to generate a light source control signal. A data driver is configured to generate data voltages based on the data signal. A display panel is configured to display an output image based on the data voltages. A light source is configured to provide light to the display panel based on the light source control signal.

A method of driving a display apparatus includes converting input image data into a hue, saturation, brightness (HSV) color space. A saturation histogram of an input image is generated based on the converted input image data. A saturation gain curve and a dimming value are generated based on the saturation histogram. Saturation of the input image is controlled based on the saturation gain curve to display an output image. Luminance of the input image is controlled based on the dimming value to provide light to a display panel.

A method for driving a display apparatus includes receiving an input image conforming to a standard dynamic range (SDR) format. The received input image is converted into a hue, saturation, brightness (HSV) color space. The saturation of the input image is modified, while in the HSV color space, to produce an output image conforming to a high dynamic range (HDR) format. In modifying the saturation of the input image, saturation is not changed for colors determined to be memorial colors. The output image is displayed.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF EMBODIMENTS

Figure 1:
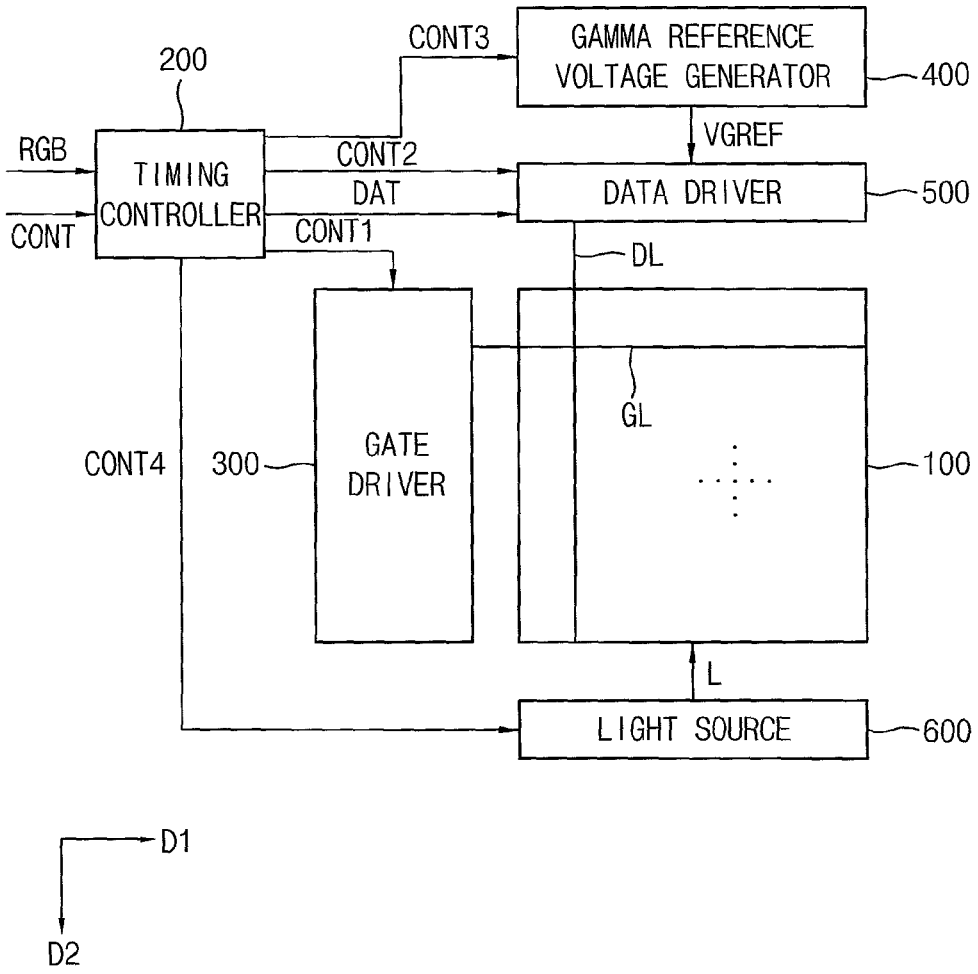
FIG. 1 is a block diagram illustrating a display apparatus according to exemplary embodiments of the present invention.

In describing exemplary embodiments of the present disclosure illustrated in the drawings, specific terminology is employed for sake of clarity. However, the present disclosure is not intended to be limited to the specific terminology so selected, and it is to be understood that each specific element includes all technical equivalents which operate in a similar manner.

Hereinafter, the present inventive concept will be explained in detail with reference to the accompanying drawings.

FIG. 1 is a block diagram illustrating a display apparatus according to exemplary embodiments of the present invention.

Referring to FIG, 1, the display apparatus includes a display panel 100 and a panel driver. The panel driver includes a timing controller 200, a gate driver 300, a gamma reference voltage generator 400, a data driver 500, and a light source 600.

The display panel 100 includes a display region for displaying an image and a peripheral region adjacent to the display region, for example, surrounding the display region. The display region may be divided into a plurality of blocks.

The display panel 100 includes a plurality of gate lines GL, a plurality of data lines DL, and a plurality of pixels electrically connected to the gate lines GL and the data lines DL. The gate lines GL extend in a first direction D1 and the data lines DL extend in a second direction D2 crossing the first direction D1.

In some exemplary embodiments of the present invention, the pixels may include a switching element, a liquid crystal capacitor, and a storage capacitor. The liquid crystal capacitor and the storage capacitor may be electrically connected to the switching element. The pixels may be arranged in a matrix configuration.

The timing controller 200 receives input image data RGB and an input control signal CONT from an external device. The input image data RGB may substantially the same as an input image signal. The input image data RGB may include red image data R, green image data G, and blue image data B. The input control signal CONT may include a data enable signal and a master clock signal. The input control signal CONT may further include a vertical synchronizing signal and a horizontal synchronizing signal.

The input image data RGB may be a standard dynamic range ("SDR") image or a high dynamic range ("HDR") image. The SDR image is an image based on a standard gamma curve. The HDR image is an image based on a different gamma curve from the standard gamma curve to display a wider range of color image information than the SDR image. The HDR image may have a higher contrast and/or a wider luminance range than the SDR image.

The timing controller 200 generates a first control signal CONT1, a second control signal CONT2, a third control signal CONT3, a fourth control signal CONT4, and a data signal DAT based on the input image data RGB and the input control signal CONT.

The timing controller 200 generates the first control signal CONT1 for controlling operations of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling operations of the data driver 500 based on the input control signal CONT, and outputs the second control signal CONT2 to the data driver 500. The second control signal CONT2 may include a horizontal start signal and a load signal.

The timing controller 200 generates the data signal DAT based on the input image data RGB. The timing controller 200 outputs the data signal DAT to the data driver 500. The data signal DAT may be substantially the same image data as the input image data RGB or the data signal DAT may be compensated image data generated by compensating the input image data RGB. For example, the timing controller 200 may selectively perform an image quality compensation, a spot compensation, an adaptive color correction (ACC), and/or a dynamic capacitance compensation (DCC) on the input image data RGB to generate the data signal DAT. When the input image data RGB is based on the SDR image, the timing controller 200 may generate a data signal DAT based on the SDR image by using the input image data RGB as it is, or may generate a data signal DAT based on the HDR image by compensating the input image data RGB. When the input image data RGB is based on the HDR image, the timing controller 200 may generate a data signal DAT based on the HDR image by using the input image data RGB as it is, or may generate a data signal DAT based on the SDR image by compensating the input image data RGB.

The timing controller 200 generates the third control signal CONT3 for controlling operations of the gamma reference voltage generator 400 based on the input control signal CONT, and outputs the third control signal CONT3 to the gamma reference voltage generator 400.

The timing controller 200 is described in detail bellow with reference to FIGS. 2 through 11.

The gate driver 300 generates gate signals for driving the gate lines GL in response to the first control signal CONT1 received from the timing controller 200. The gate driver 300 sequentially outputs the gate signals to the gate lines GL.

In some exemplary embodiments of the present invention, the gate driver 300 may be directly mounted on the display panel 100, or may be connected to the display panel 100 as a tape carrier package (TCP). Alternatively, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of pixel data included in the data signal DAT.

In some exemplary embodiments of the present invention, the gamma reference voltage generator 400 may be disposed in the timing controller 200, or may be disposed in the data driver 500.

The data driver 500 receives the second control signal CONT2 and the data signal DAT from the timing controller 200, and receives the gamma reference voltage VGREF from the gamma reference voltage generator 400. The data driver 500 converts the data signal DAT to data voltages having analogue levels based on the gamma reference voltage VGREF. The data driver 500 outputs the data voltages to the data lines DL.

In some exemplary embodiments of the present invention, the data driver 500 may be directly mounted on the display panel 100, or may be connected to the display panel 100 as a tape carrier package (TCP). Alternatively, the data driver 500 may be integrated on the peripheral region of the display panel 100.

The light source 600 provides light L to the display panel 100 to display the image in response to the fourth control signal CONT4 received from the timing controller 200. The fourth control signal CONT4 may be a light source control signal. The light source 600 may separately provide light L to each of a plurality of blocks of the display panel 100.

Figure 2:
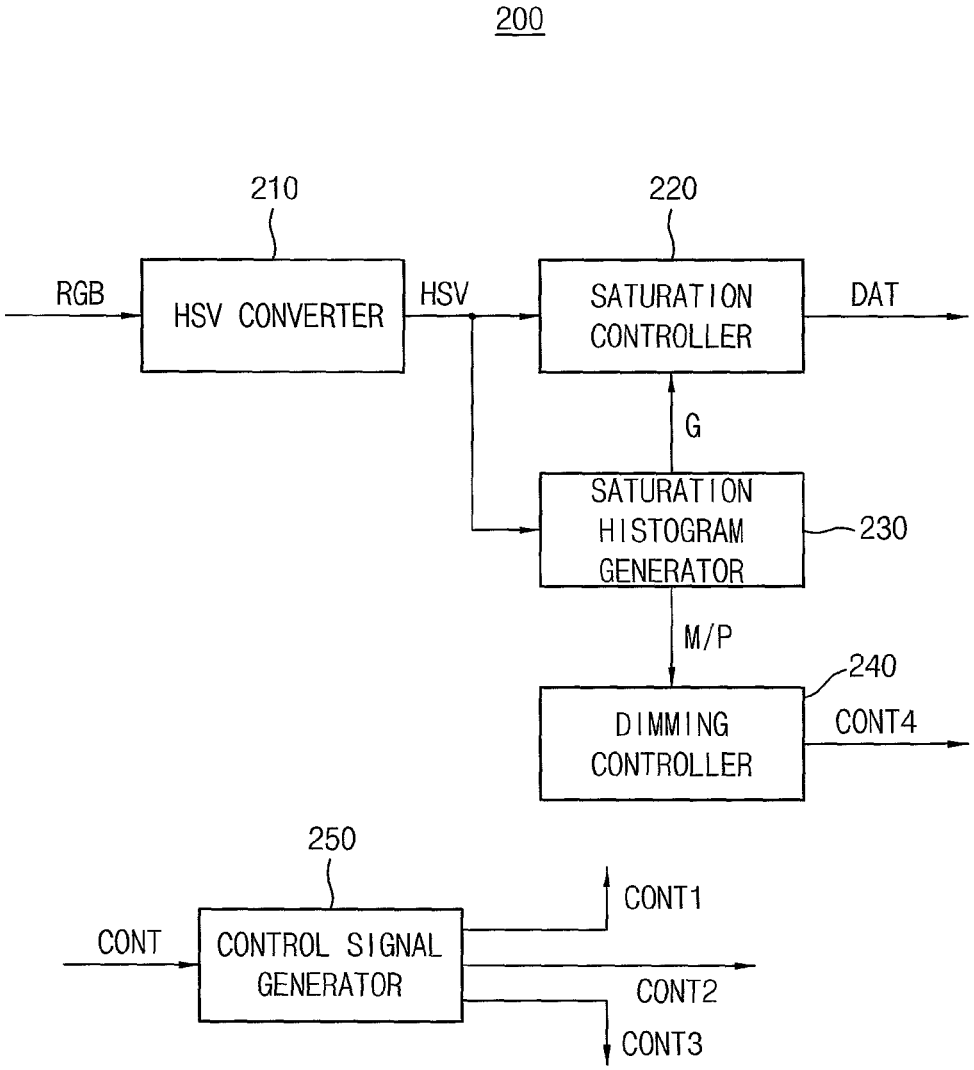
FIG. 2 is a block diagram illustrating a timing controller included in a display apparatus according to an exemplary embodiment of the present invention.

FIG. 2 is a block diagram illustrating a timing controller included in a display apparatus according to an exemplary embodiment of the present invention.

Referring to FIGS. 1 and 2, the timing controller 200 includes an HSV converter 210, a saturation controller 220, a saturation histogram generator 230, a dimming controller 240, and a control signal generator 250.

The HSV converter 210 converts the input image data RGB to image data based on an HSV color space HSV. The HSV converter 210 may separately perform the conversion for each pixel. The HSV color space is a color space based on a hue H, a saturation S, and a brightness value V. The hue H is a characteristic that distinguishes colors such as red, yellow, green, blue, and purple from one another. The saturation S is a degree of saturation indicating an intensity of a color. The brightness value V is a degree of brightness of a color. For example, the saturation S may be calculated as follows:

$$M = \max(R, G, B)$$

$$m = \min(R, G, B)$$

$$C = M - m$$

$$S_{HSV} = \begin{cases} 0, & \text{if } V = 0 \\ \frac{C}{V}, & \text{otherwise} \end{cases}$$

The HSV converter 210 may provide the image data based on the HSV color space HSV to the saturation controller 220 and the saturation histogram generator 230.

The saturation histogram generator 230 generates a saturation histogram of an input image based on the image data in the HSV color space HSV. The saturation histogram generator 230 analyzes the saturation histogram and provides a result of the analysis to the saturation controller 220 and the dimming controller 240. For example, the saturation histogram generator 230 provides a maximum value of saturation gains G to the saturation controller 220, provides a mean value of saturations of the input image M, and provides a mode value of the saturations of the input image P to the dimming controller 240. The mode value of the saturations of the input image P is a saturation that occurs most often among the saturations of the input image.

The saturation histogram generator 230 is described in detail below with reference to FIG. 3.

The saturation controller 220 generates a saturation gain curve by referring to a saturation look-up table based on the maximum value of the saturation gains G. The saturation controller 220 may modify the saturation gain curve based on the image data based on the HSV color space HSV. The saturation controller 220 controls the saturations of the input image based on the saturation gain curve. The saturation controller 220 generates the data signal DAT based on the controlled saturations. The saturation controller 220 outputs the data signal DAT to the data driver 500.

The saturation controller 220 is described in detail below with reference to FIGS. 4 through 7.

The dimming controller 240 generates a dimming value by referring to a luminance look-up table based on the mean value of the saturations M and the mode value of the saturations P. The dimming controller 240 generates the fourth control signal CONT4 based on the dimming value. The dimming controller 240 outputs the fourth control signal CONT4 to the light source 600.

The dimming controller 240 is described in detail below with reference to FIGS. 8 through 10.

The control signal generator 250 generates the first control signal CONT1, the second control signal CONT2, and the third control signal CONT3, based on the input control signal CONT. The control signal generator 250 outputs the first control signal CONT1 to the gate driver 300. The control signal generator 250 outputs the second control signal CONT2 to the data driver 500. The control signal generator 250 outputs the third control signal CONT3 to the gamma reference voltage generator 400.

Figure 3:
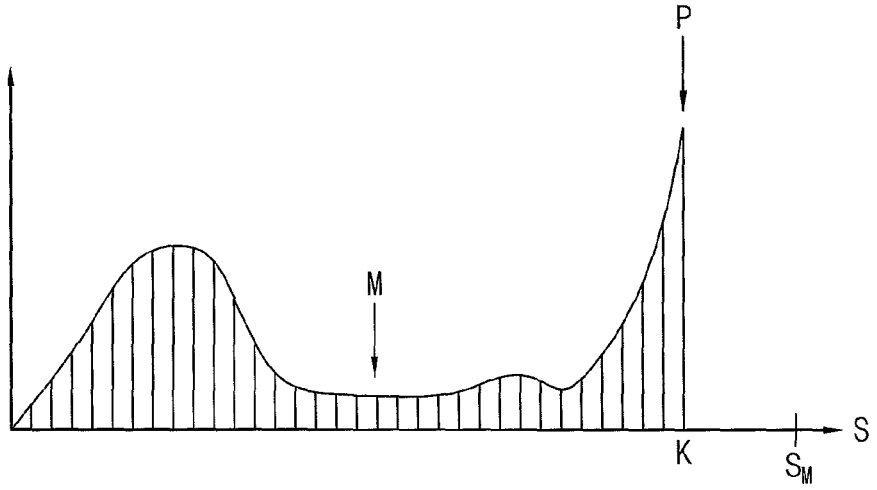
FIG. 3 is a diagram illustrating a saturation histogram of an input image, the saturation histogram being generated in a display apparatus according to an exemplary embodiment of the present invention.

FIG. 3 is a diagram illustrating a saturation histogram of an input image, the saturation histogram being generated in a display apparatus according to an exemplary embodiment of the present invention.

Referring to FIGS. 1 through 3, the saturation histogram generator 230 generates the saturation histogram of the input image. An x-axis of the saturation histogram indicates a level of saturation. A y-axis of the saturation histogram indicates the number of pixels having the saturation. The saturation histogram generator 230 may separately generate the saturation histogram for each frame of the image data.

The saturation histogram generator 230 may extract a maximum allowed saturation $S_M$, the mean value of the saturations M, and the mode value of the saturations P from the saturation histogram. The saturation histogram generator 230 may compare the maximum allowed saturation $S_M$ and the mode value of the saturations P to calculate the maximum value of the saturation gains G. The maximum value of the saturation gains G may be less than or equal to the maximum allowed saturation $S_M$ divided by the mode value of the saturations P.

The saturation histogram generator 230 provides the maximum value of the saturation gains G to the saturation controller 220. The saturation histogram generator 230 provides the mean value of the saturations M and the mode value of the saturations P to the dimming controller 240.

Figure 4:
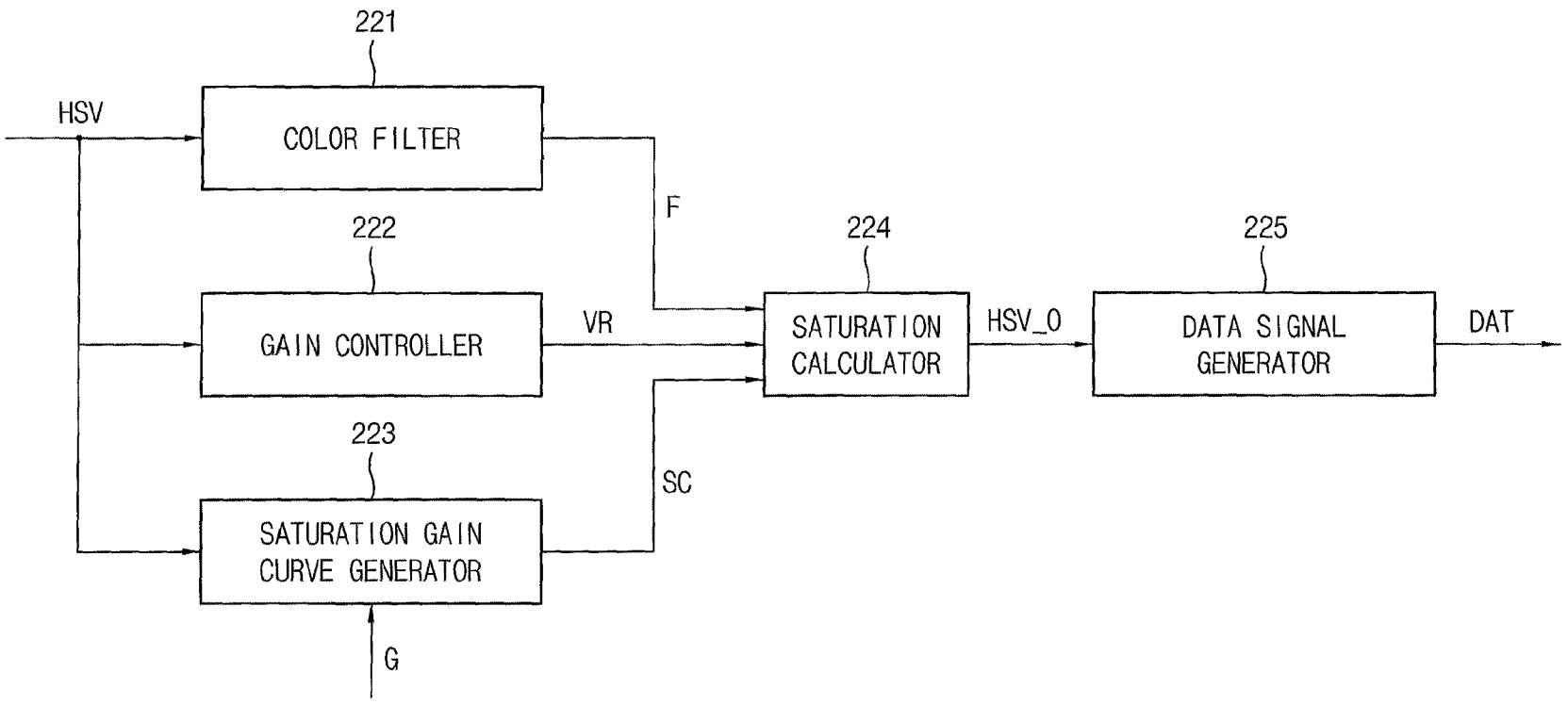
FIG. 4 is a block diagram illustrating a saturation controller included in a display apparatus according to an exemplary embodiment of the present invention.
Figure 5:
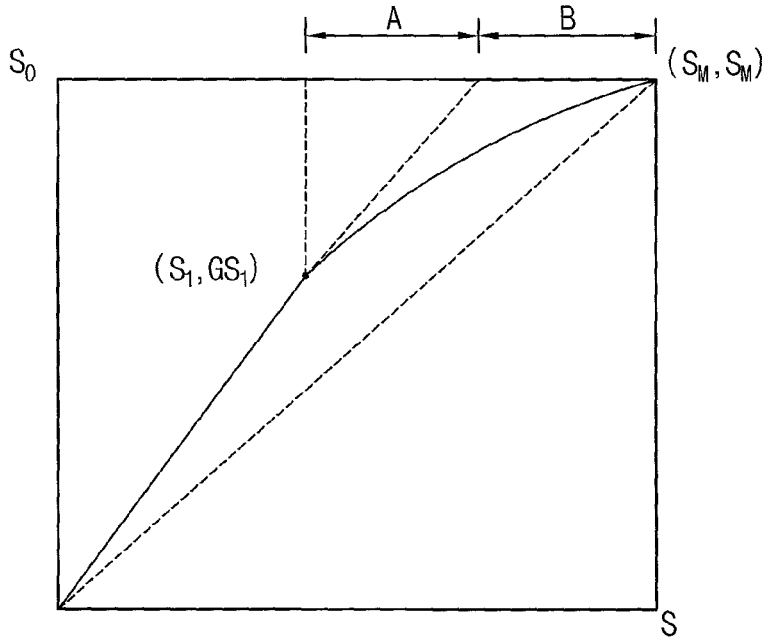
FIG. 5 is a diagram illustrating a saturation gain curve generated in a display apparatus according to an exemplary embodiment of the present invention.
Figure 6:
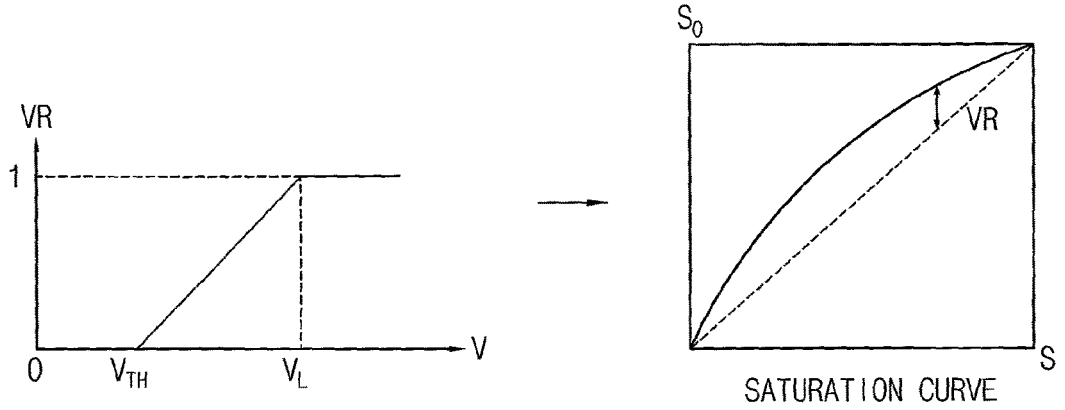
FIG. 6 is a diagram illustrating a variation of a saturation gain according to a value in a display apparatus according to an exemplary embodiment of the present invention.

FIG. 4 is a block diagram illustrating a saturation controller included in a display apparatus according to an exemplary embodiment of the present invention. FIG. 5 is a diagram illustrating a saturation gain curve generated in a display apparatus according to an exemplary embodiment of the present invention. FIG. 6 is a diagram illustrating a variation of a saturation gain according to a value in a display apparatus according to an exemplary embodiment of the present invention.

Referring to FIGS. 1 through 4, the saturation controller 220 may include a color filter 221, a gain controller 222, a saturation gain curve generator 223, a saturation calculator 224, and a data signal generator 225.

The saturation gain curve generator 223 receives the maximum value of the saturation gains G from the saturation histogram generator 230. The saturation gain curve generator 223 may include the saturation look-up table storing saturation gain curves SC according to the maximum value of the saturation gains G. The saturation gain curve generator 223 generates the saturation gain curve SC by referring to the saturation look-up table based on the maximum value of the saturation gains G.

Referring to FIG. 5, the saturation gain curve SC is a curve illustrating a relationship between the saturation of the input image S and a saturation of an output image $S_0$. When the saturation of the input image S is lower than a boundary saturation $S_1$ in the saturation gain curve SC, the saturation gain curve SC may be a straight line, a slope of which is the maximum value of the saturation gains G. When the saturation of the input image S is greater than or equal to the boundary saturation $S_1$ in the saturation gain curve SC, the saturation gain curve SC may be a curve with a negative slope. For example, when the saturation of the input image S is greater than or equal to the boundary saturation $S_1$ in the saturation gain curve SC, the saturation gain curve SC may be a quadric curve with a negative slope. For example, the saturation gain curve SC may satisfy the following equation:

$$S < S_1 : S_O = GS$$

$$S \geq S_1 : S_O = \frac{GS_1 - S_M}{(S_1 - S_M)^2}(S - S_M)^2 + S_M$$

The boundary saturation $S_1$ of the equation above may satisfy the following equation:

$$S_1 = \left(\frac{2}{G} - 1\right)S_M$$

In this case, the section "A" has substantially the same length as the section "B" as shown in FIG. 5.

In the saturation gain curve SC, the higher the saturation of the input image S is, the lower the saturation gain $S_0/S$ may be. For example, in a section where the saturation of the input image S is greater than or equal to the boundary saturation $S_1$ in the saturation gain curve SC, the higher the saturation of the input image S is, the lower the saturation gain $S_0/S$ may be.

According to an exemplary embodiment of the present invention, the saturation gain curve may have a decreasing (negative) slope in a section of a relatively high saturation. Accordingly, a saturation gain decreases as the saturation increases in the section. Thus, saturations of an output image can be prevented from being additionally saturated in the section.

Referring to FIGS. 1 through 4, the color filter 221 may determine if each of the pixels has a hue H within a first hue range and a saturation S within a first saturation range based on the image data and the HSV color space HSV. The first hue range and the first saturation range may correspond to a memorial color. Memorial colors are those colors that can be easily seen in nature such as a skin color, a color of the sky, a color of grass, and so on. The memorial color may be variously set by a manufacturer of the display device.

The color filter 221 determines if each of the pixels has a hue H within the first hue range and a saturation S within the first saturation range to generate a memorial color signal F. The color filter 221 provides the memorial color signal F to the saturation calculator 224.

The gain controller 222 generates a brightness value signal VR controlling the saturation gain curve SC according to a brightness value of the input image V based on the image data based on the RSV color space HSV. The gain controller 222 provides the brightness value signal VR to the saturation calculator 224.

Referring to FIGS. 1 through 5, the saturation calculator 224 calculates the saturation of the output image $S_0$ based on the saturation gain curve SC, the memorial color signal F, and the brightness value signal VR.

The saturation calculator 224 modifies the saturation gain curve SC corresponding to a pixel having a hue H within the first hue range and a saturation S within the first saturation range based on the memorial color signal F. For example, the saturation calculator 224 may modify the saturation gain curve SC so that the saturation of the output image $S_0$ is substantially the same as the saturation of the input image S, corresponding to the pixel having a hue H within the first hue range and a saturation S within the first saturation range. Alternatively, the saturation calculator 224 may modify the saturation gain curve SC to have lower saturation gains compared to other pixels, corresponding to the pixel having a hue H within the first hue range and a saturation S within the first saturation range. For example, the saturation calculator 224 may modify the saturation gain curve SC to have about 80% lower saturation gains compared to other pixels, corresponding to the pixel having a hue H within the first hue range and a saturation S within the first saturation range.

According to exemplary embodiments of the present invention, a pixel having a certain hue and saturation range so as to display a memorial color has a different saturation gain from other pixels so that a natural image can be displayed.

Referring to FIGS. 1 through 6, the saturation calculator 224 modifies the saturation gain curve SC according to the brightness value of the input image V based on the brightness value signal VR. The saturation calculator 224 may modify the saturation gain curve SC so that the lower the brightness value of the input image V is, the lower the saturation gain $S_0/S$ is. For example, when the brightness value of the input image V is lower than a threshold brightness value $V_{TH}$, the saturation calculator 224 may modify the saturation gain curve SC so that the saturation of the output image $S_0$ is substantially the same as the saturation of the input image S. When the brightness value of the input image V is higher than the threshold brightness value $V_{TH}$, the saturation calculator 224 may modify the saturation gain curve SC so that the lower the brightness value of the input image V is, the lower the saturation gain $S_0/S$ is. When the brightness value of the input image V is higher than a limit brightness value $V_L$, the saturation calculator 224 may maintain the saturation gain curve SC as it is regardless of the brightness value of the input image V.

According to exemplary embodiments of the present invention, when a saturation is increased at a fixed ratio regardless of a brightness value of an input image, it is possible to prevent an unnatural image due to a large change in a hue of relatively low brightness values.

Figure 7:
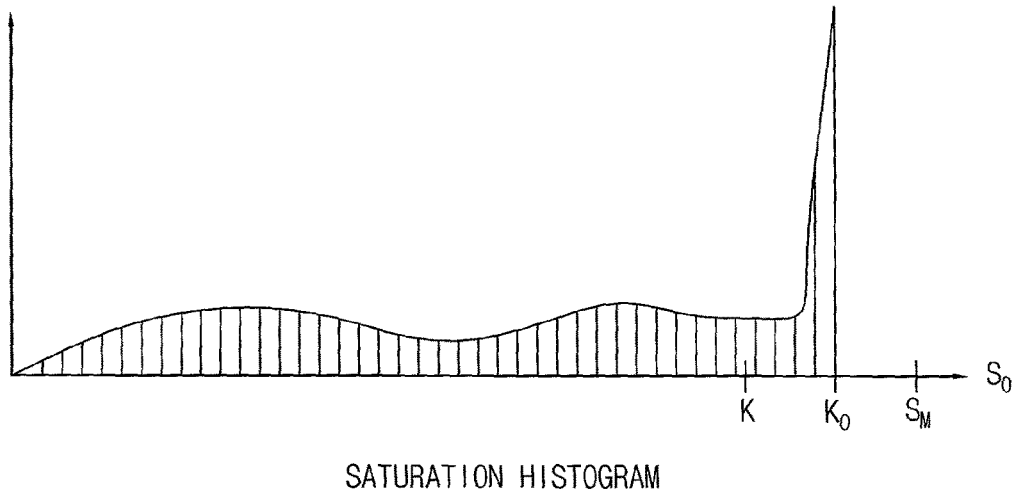
FIG. 7 is a diagram illustrating a saturation histogram of an output image of a display apparatus according to an exemplary embodiment of the present invention.

FIG. 7 is a diagram illustrating a saturation histogram of an output image of a display apparatus according to an exemplary embodiment of the present invention.

Referring to FIGS. 3 and 7, a maximum value of the saturations of the output image $K_0$ is higher than a maximum value of the saturations of the input image K. The saturation histogram is overall shifted in a direction of increased saturation. $K_0$ divided by K may be less than or equal to the maximum value of the saturation gains G.

Figure 8:
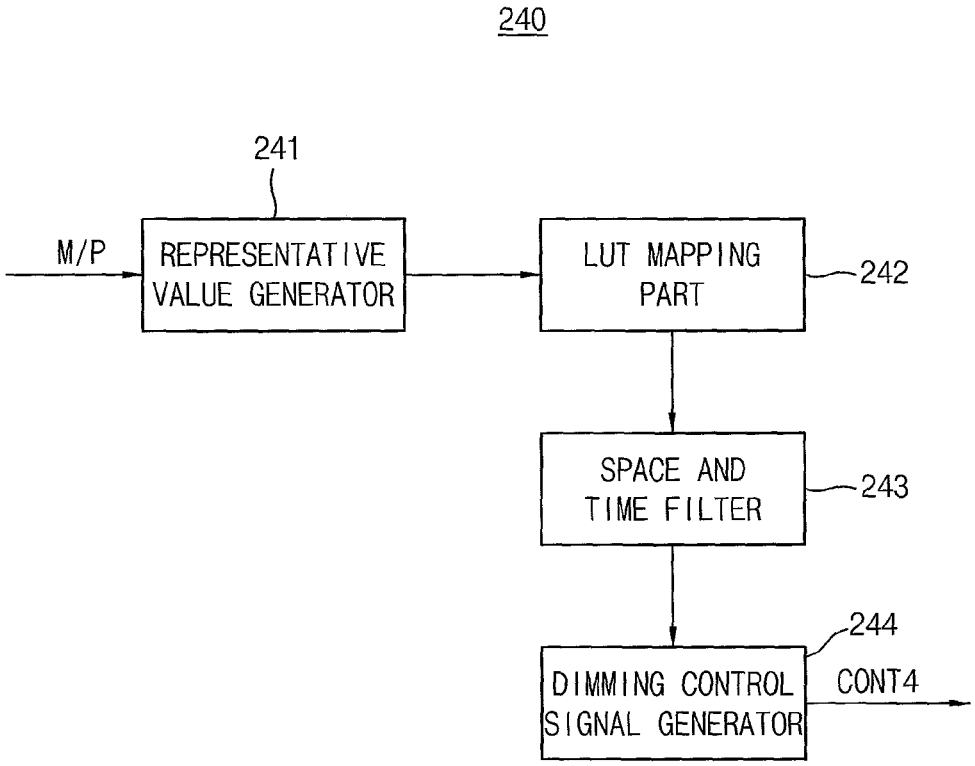
FIG. 8 is a block diagram illustrating a dimming controller included in a display apparatus according to an exemplary embodiment of the present invention.

FIG. 8 is a block diagram illustrating a dimming controller included in a display apparatus according to an exemplary embodiment of the present invention. FIG. 9 is a block diagram illustrating an example of a timing controller included in a display apparatus according to an exemplary embodiment of the present invention. FIG. 10 is a diagram illustrating a display panel included in a display apparatus according to an exemplary embodiment of the present invention.

Referring to FIGS. 1 through 3 and 8, the dimming controller 240 may include a representative value generator 241, a LUT mapping part 242, a space and time filter 243, and a dimming control signal generator 244.

Figure 10:
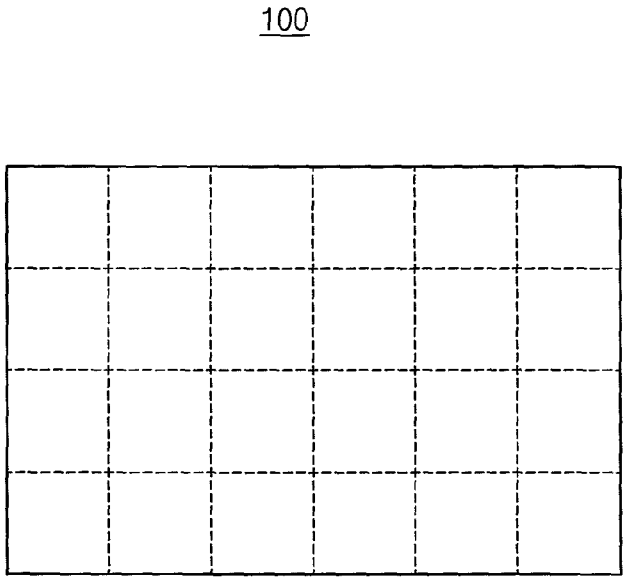
FIG. 10 is a diagram illustrating a display panel included in a display apparatus according to an exemplary embodiment of the present invention.

Referring to FIGS. 1 and 10, the display panel 100 may be divided into a plurality of blocks. The dimming controller 240 may separately generate the dimming value for each of the blocks. The light source 600 may separately provide light L for each of the blocks.

The saturation histogram generator 230 may separately generate the saturation histogram for each of the blocks. The saturation histogram generator 230 may extract the mean value of the saturations M and the mode value of the saturations P from each saturation histogram.

The representative value generator 241 may calculate a representative value D based on the mean value of the saturations M and the mode value of the saturations P. The representative value D may satisfy the following equation:

$$D=\alpha M+(1-\alpha)P$$

Here, the weighted value a may have a value between 0 and 1.

The representative value generator 241 may provide the representative value D to the LUT mapping part 242.

The LUT mapping part 242 may include the luminance look-up table storing luminance values according to the representative value D. The LUT mapping part 242 generates the luminance value by referring to the luminance look-up table according to the representative value D. The LUT mapping part 242 may provide the generated luminance value to the space and time filter 243.

The space and time filter 243 may include a time filter and a space filter. The space and time filter 243 may use the time filter to control the luminance value so that flickers do not occur between frames. The space and time filter 243 may use the space filter to control the luminance value so that boundaries of the blocks are not seen. The space and time filter 243 may control the luminance value to generate the dimming value. The space and time filter 243 may provide the generated dimming value to the dimming control signal generator 244.

The dimming control signal generator 244 generates the fourth control signal CONT4 based on the dimming value. The dimming control signal generator 244 may provide the fourth control signal CONT4 to the light source 600.

Figure 9:
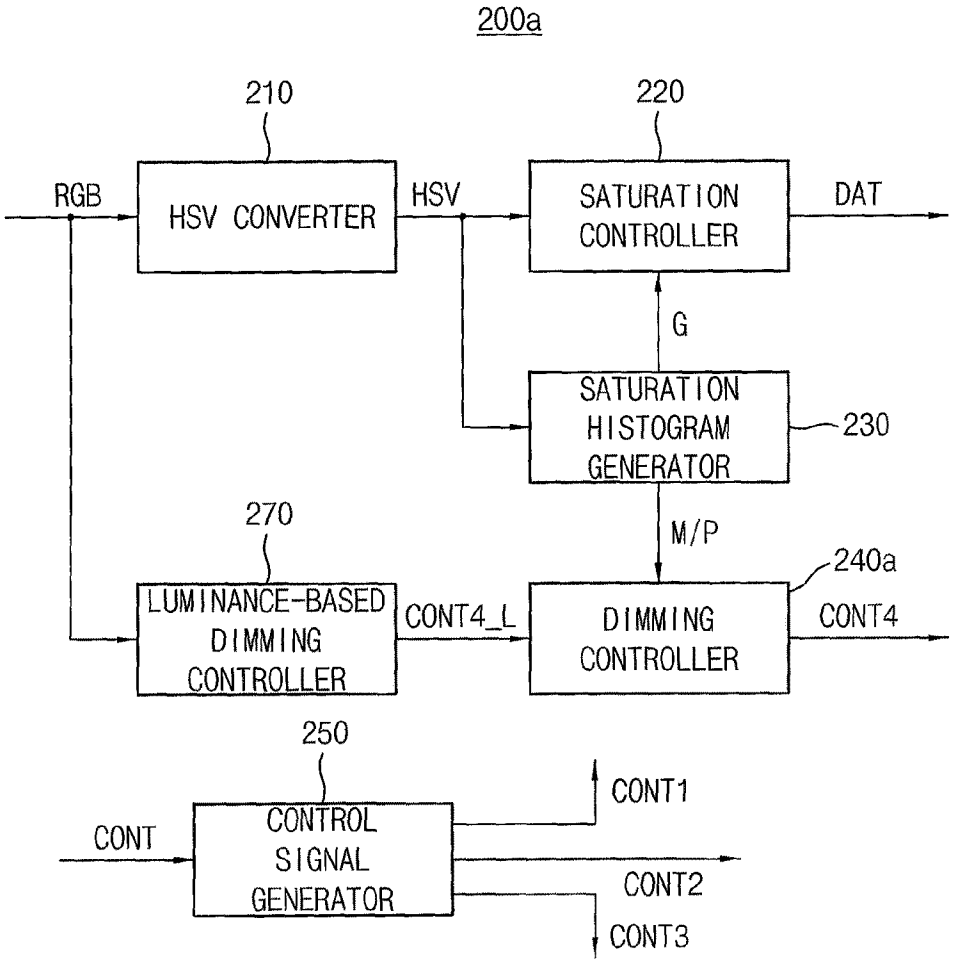
FIG. 9 is a block diagram illustrating an example of a timing controller included in a display apparatus according to an exemplary embodiment of the present invention.

Referring to FIG. 9, a timing controller 200*a* may further include a luminance-based dimming controller 270. The luminance-based dimming controller 270 may control luminance of the input image based on the input image data RGB to generate a luminance-based light source control signal CONT4_L. The luminance-based dimming controller 270 may provide the luminance-based light source control signal CONT4_L to a dimming controller 240*a*.

The dimming controller 240*a* may combine the saturation-based dimming value and the luminance-based light source control signal CONT4_L to generate the fourth control signal CONT4. The dimming controller 240*a* may output the fourth control signal CONT4 to the light source 600.

Figure 11:
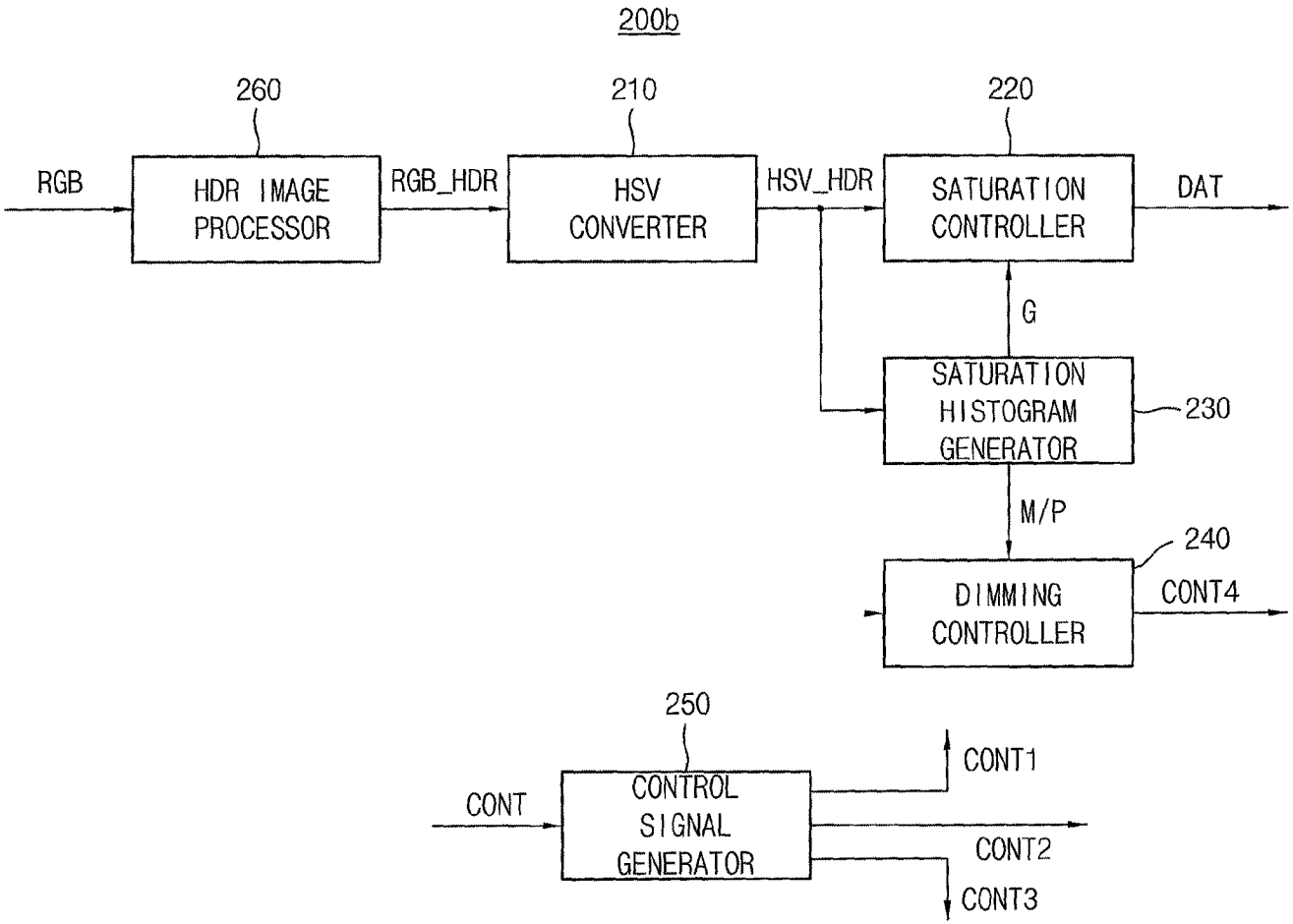
FIG. 11 is a block diagram illustrating an example of a timing controller included in a display apparatus according to an exemplary embodiment of the present invention.

FIG. 11 is a block diagram illustrating an example of a timing controller included in a display apparatus according to an exemplary embodiment of the present invention.

Referring to FIGS. 1, 2 and 11, a timing controller 200*b* may further include a HDR image processor 260.

The UDR image processor 260 receives input image data RGB based on the SDR image. The HDR image processor 260 may convert the input image data RGB based on the SDR image to image data RGB_HDR based on the HDR image. The HDR image processor 260 may provide the image data RGB_HDR based on the HDR image to the HSV converter 210.

Figure 12:
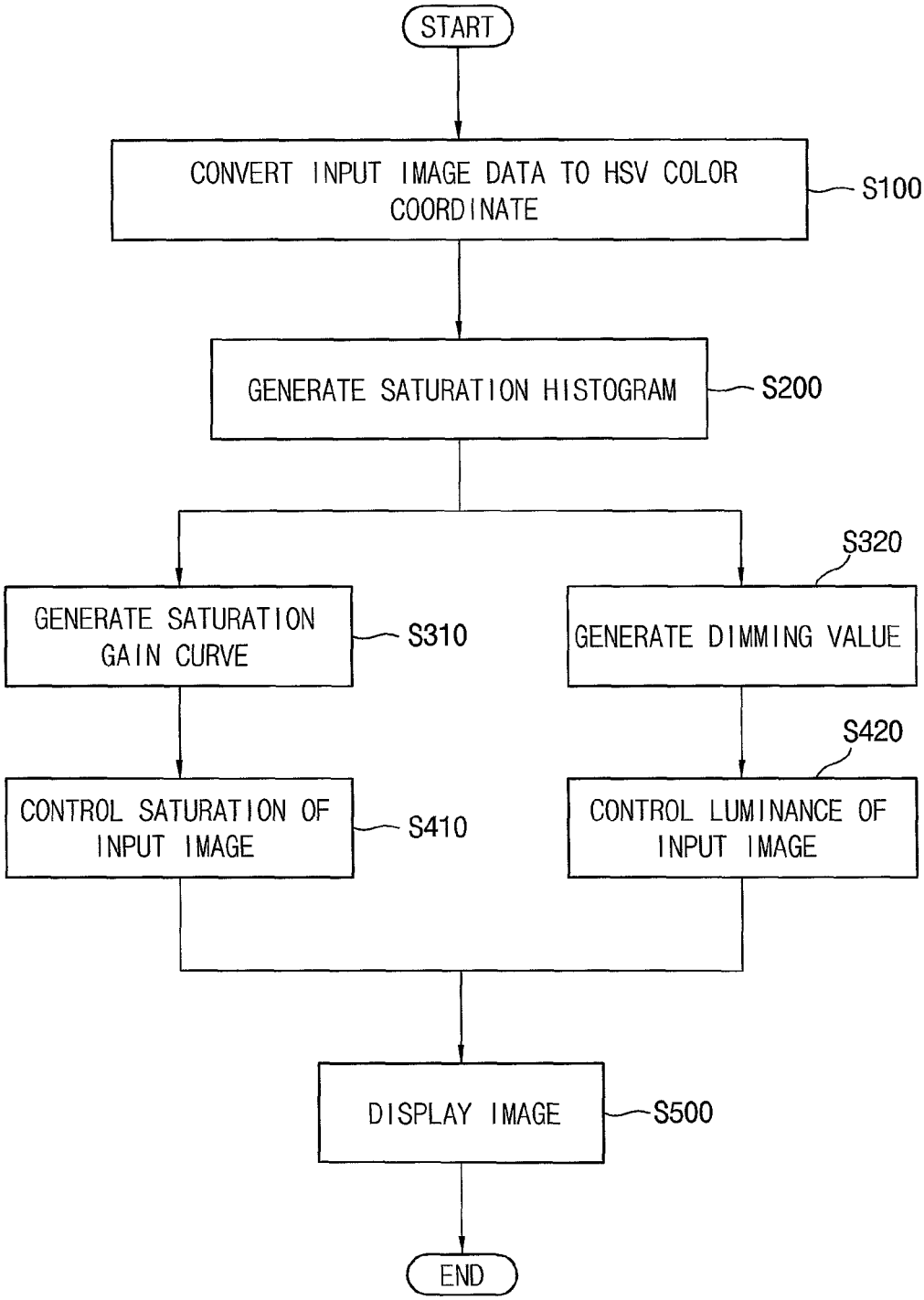
FIG. 12 is a flow chart illustrating a method of driving a display apparatus according to an exemplary embodiment of the present invention.

FIG. 12 is a flow chart illustrating a method of driving a display apparatus according to an exemplary embodiment of the present invention.

Referring to FIG. 12, a method of driving a display apparatus includes converting input image data into an HSV color space S100. A saturation histogram of an input image is generated based on the converted image data S200. A saturation gain curve S310 and a dimming value are generated based on the saturation histogram S320. Saturation of the input image is controlled based on the saturation gain curve S410 and luminance of the input image is controlled based on the dimming value S420. An output image is displayed based on the controlled saturation and luminance S500.

The above described embodiments of the present invention may be used in a display apparatus and/or a system including the display apparatus, such as a mobile phone, a smart phone, a PDA, a PMP, a digital camera, a digital television, a set-top box, a music player, a portable game console, a navigation device, a personal computer (PC), a server computer, a workstation, a tablet computer, a laptop computer, a smart card, a printer, etc.

Although exemplary embodiments of the present invention have been described and illustrated, those skilled in the art will readily appreciate that many modifications may be made to these exemplary embodiments of the present invention without materially departing from the scope of the present disclosure. Accordingly, all such modifications are intended to be included within the scope of the present disclosure.

What is claimed is:

1. A display apparatus comprising:

a timing controller configured to:

convert input image data into a hue, saturation, brightness (HSV) color space to generate a saturation histogram;

generate a saturation gain curve and a dimming value based on the saturation histogram;

control saturation of an input image based on the saturation gain curve to generate a data signal; and control luminance of the input image based on the dimming value to generate a light source control signal;

a data driver configured to generate data voltages based on the data signal;

a display panel configured to display an output image based on the data voltages; and a light source configured to provide light to the display panel based on the light source control signal.

2. The display apparatus of claim 1, wherein the timing controller is configured to compare a mode value of the saturation of the input image with a maximum saturation value based on the saturation histogram to generate the saturation gain curve.

3. The display apparatus of claim 2, wherein a maximum saturation gain in the saturation gain curve is less than or equal to the maximum saturation value divided by the mode value of the saturation of the input image.

4. The display apparatus of claim 3, wherein the saturation gain curve satisfies the equation:

$$S < S_1 : S_O = GS$$

$$S \geq S_1 : S_O = \frac{GS_1 - S_M}{(S_1 - S_M)^2}(S - S_M)^2 + S_M$$

$$S_1 = \left(\frac{2}{G} - 1\right)S_M$$

where $S_0$=a saturation of the output image, S=the saturation of the input image, G=the maximum value of the saturation gain, $S_1$=a boundary saturation, and $S_M$=the maximum saturation value.

5. The display apparatus of claim 1, wherein, in the saturation gain curve, the higher the saturation of the input image is, the lower a saturation gain is.

6. The display apparatus of claim 1, wherein the timing controller is configured to modify the saturation gain curve for a pixel having a hue within a first hue range and a saturation within a first saturation range.

7. The display apparatus of claim 6, wherein the first hue range and the first saturation range correspond to a memorial color.

8. The display apparatus of claim 1, wherein the timing controller is configured to modify the saturation gain curve based on a brightness value of the input image.

9. The display apparatus of claim 8, wherein the timing controller is configured to modify the saturation gain curve so that the lower the brightness value of the input image is, the lower a saturation gain is.

10. The display apparatus of claim 1, wherein the timing controller is configured to generate the dimming value by using a mode value and a mean value of the saturations based on the saturation histogram.

11. The display apparatus of claim 10, wherein the timing controller is configured to generate the dimming value by using a representative value and referring to a look-up table, the representative value satisfying the following equation:

$$D=\alpha M+(1-\alpha)P$$

where D=the representative value, and α=a weighted value.

12. The display apparatus of claim 10, wherein the display panel is divided into a plurality of blocks, and the timing controller is configured to separately generate the saturation histogram for each of the plurality of blocks to separately generate the dimming value for each of the plurality of blocks.

13. The display apparatus of claim 12, wherein the timing controller is configured to:

separately generate a luminance-based dimming value for each of the plurality of blocks based on the luminance of the input image; and control the luminance of the input image by combining the dimming value and the luminance-based dimming value.

14. The display apparatus of claim 1, wherein the timing controller is configured to convert the input image to a high dynamic range ("HDR") image to generate the input image data.

15. A method of driving a display apparatus, the method comprising:

converting input image data into a hue, saturation, brightness (HSV) color space;

generating a saturation histogram of an input image based on the converted input image data;

generating a saturation gain curve and a dimming value based on the saturation histogram;

controlling saturation of the input image based on the saturation gain curve to display an output image; and controlling luminance of the input image based on the dimming value to provide light to a display panel.

16. The method of claim 15, wherein the generating the saturation gain curve comprises:

comparing a mode value of the saturation of the input image with a maximum saturation value based on the saturation histogram to calculate a maximum value of saturation gains.

17. The method of claim 15, wherein the controlling the saturation of the input image comprises:

modifying the saturation gain curve corresponding to a pixel having a hue within a first hue range and a saturation within a first saturation range; and controlling a saturation of the pixel based on the modified saturation gain curve.

18. The method of claim 15, wherein the controlling the saturations of the input image comprises:

modifying the saturation gain curve so that the lower a brightness value of the input image is, the lower a saturation gain is; and controlling the saturations of the input image based on the modified saturation gain curve.

19. The method of claim 15, wherein the display panel is divided into a plurality of blocks, and wherein the generating the saturation gain curve comprises separately generating the saturation histogram for each of the plurality of blocks, and the generating the dimming value comprises separately generating the dimming value for each of the plurality of blocks by using a mode value and a mean value of the saturation of the input image based on the saturation histogram.

20. The method of claim 15, further comprising converting the input image to a high dynamic range ("HDR") image to generate the input image data.

* * * * *